United States Patent [19]

Sivignon

[11] 4,089,635

[45] May 16, 1978

[54] PORTABLE GAS LAMPS

[76] Inventor: Pierre Sivignon, 22, rue Domer, Lyons, France, 69007

[21] Appl. No.: 736,058

[22] Filed: Oct. 27, 1976

[30] Foreign Application Priority Data

Nov. 4, 1975 France ..... 75 34371

[51] Int. Cl.[2] ..... F21L 19/00

[52] U.S. Cl. ..... 431/111; 126/255; 362/179

[58] Field of Search ..... 431/100, 111, 112, 113, 431/104, 344; 126/255; 240/38, 40, 102, 11 E

[56] References Cited

U.S. PATENT DOCUMENTS

| | | | |
|---|---|---|---|
| 602,505 | 4/1898 | Graefe | 431/111 |
| 713,127 | 11/1902 | Marsh | 431/111 |
| 948,995 | 2/1910 | Hulsie | 431/111 |
| 3,210,537 | 10/1965 | Groves | 431/344 X |

*Primary Examiner*—Edward G. Favors
*Attorney, Agent, or Firm*—Dowell & Dowell

[57] ABSTRACT

A portable gas lamp of the type having a cylindrical base acting as a casing for a removable gas cartridge and a cylindrical glass chimney which extends upwardly from the base and surrounds an incandescent mantle, in which there is provided a cylindrical sleeve which surrounds the previously stated parts of the lamp and is movable between a first position where it protectively covers the said glass chimney and a second, lower position in which the glass chimney is uncovered and the sleeve surrounds the base. The sleeve is preferably slidingly supported on a pair of upright posts attached to the base, and means is provided for securing the sleeve at least in its uppermost position where it covers the glass chimney.

8 Claims, 4 Drawing Figures

PORTABLE GAS LAMPS

BACKGROUND OF THE INVENTION

The invention relates to portable lamps, comprising an incorporated gas supply, particularly in the form of a removable charging cartridge.

Portable gas lamps are already known which contain a supply of liquefied combustible gas under pressure, for example, butane gas, which is contained in a removable gas cartridge, the said cartridge being in a cylindrical base, for example, made in the form of a casing, the cylindrical base being extended upwardly by a likewise cylindrical glass or chimney, arranged around an incandescent mantle and held on the said base by suitable means.

Because of their illuminating power, lamps of this type are very widely used for touring and camping, but the user is generally troubled as regards sufficiently protecting the glass when the lamp is loosely packed with other articles. If the original packaging arrangement has been provided for receiving the lamp in the fitted state and if it is retained by the user, it may possibly be used again, but when the lamp is being used, such a packaging arrangement is cumbersome and is likely to deteriorate or be lost.

The invention has for its particular object to overcome these inconveniences and to enable the user to have continuously at his disposal a incorporated means for protecting the glass.

SUMMARY OF INVENTION

In accordance with the invention, a sliding sleeve is secured on the base of the lamp which sleeve is so arranged as to be able to be slid upwardly and secured around the glass as a protective covering as can be particularly seen in FIG.2.

BRIEF DESCRIPTION OF THE DRAWINGS

The invention may be fully understood in every respect by reference to the description which follows and also the accompanying drawings, which description and drawings, given particularly by way of illustration, will also make apparent other objectives and advantages, and also the important characteristics of the invention, of which the main ones are also defined in the accompanying claims. In the drawings.

DESCRIPTION OF THE ILLUSTRATED EMBODIMENT

Figure 1:
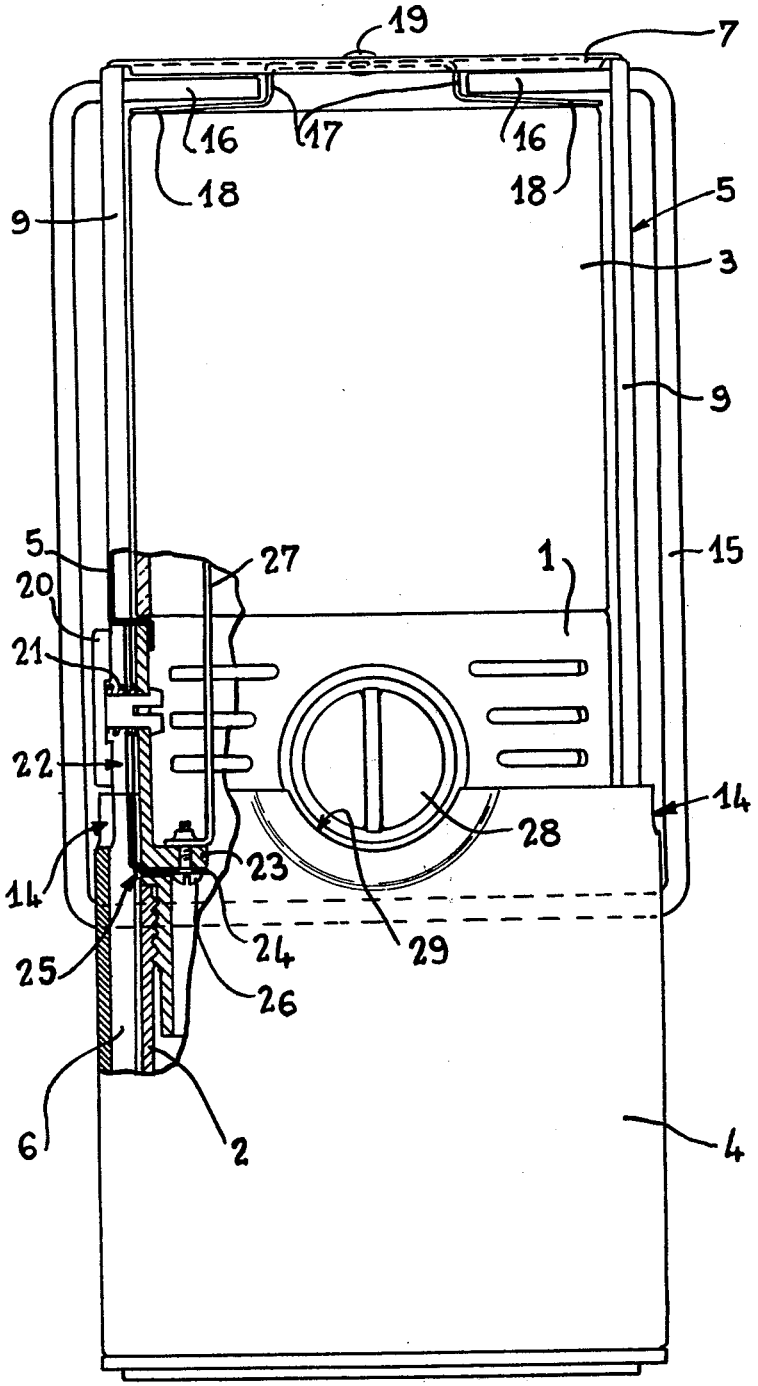
FIG. 1 shows diagrammatically a portable gas lamp developed in accordance with the invention and in its position in use, partly in elevation and partly in section.

Referring to the drawings, the portable gas lamp has a cylindrical base 1 and 2, which acts as a casing for a removable gas cartridge (not shown). A cylindrical glass cover or chimney 3 extends upwards from the base 1 and 2 and surrounds an incandescent mantle (also not shown) which is connected to the cartridge in a known manner. A sleeve 4 which surrounds the lamp and is secured thereto, is so arranged as to be able to be slid upwardly to cover the glass protectively in one position, and to be slid down over the base 1, 2 in another position thereby uncovering the glass. Provision is made for securing the sleeve in its top position.

Figure 3:
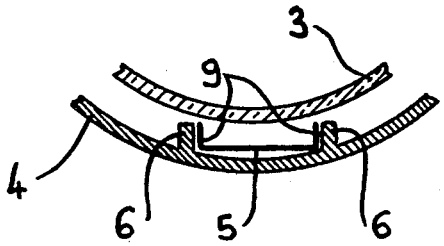
FIG. 3 is a partial section of the lamp on the line III—III of FIG. 2.
Figure 4:
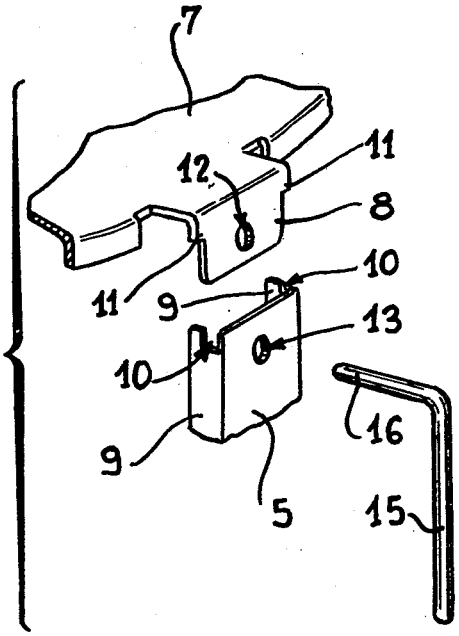
FIG. 4 is a perspective view showing an assembly in accordance with the invention of certain parts of which the same lamp is constituted.

So as to be able to guide the sleeve 4 during this translatory movement, which it has to be able to carry out around the glass 3 and to hold it firmly around the latter, the base 1 is provided with at least two parallel uprights or posts 5, which are extended along the glass 3 and along the generatrices thereof and which coact with the sleeve 4 so as to act as a guiding and holding rail for the sleeve around the glass, as can be particularly seen in FIG. 3.

In the constructional form as illustrated, the uprights or posts 5 are formed by a U-section metal member.

The sleeve 4, which is preferably made by injection moulding from a plastic material, advantageously comprises two parallel ribs 6 for coacting with each of the uprights 5, one of the said uprights 5 being fitted between the said ribs, thereby preventing the sleeve 4 from turning coaxially on the base 1.

At their free upper ends, the uprights 5 are braced by a substantialy flat cover 7, which extends horizontally at a certain distance above the glass 3. This cover 7, which is advantageously made by cutting and stamping from a metal plate, comprises peripheral lugs 8, bent downwardly at right-angles so as to be nested in the uprights 5. So as to prevent any radial displacement of the uprights 5 on the cover, notches 10 are formed in the lateral wings 9 of these uprights and enlargements in the form of shoulders 11 corresponding thereto are provided above a rectangular part of the lug 8 adapted to enter between the wings 9, the said shoulders being nested in the cut-outs or slots 10 when the lugs 8 are pushed axially to their full extent into the uprights 5. In this position, holes 12 and 13 respectively provided so as to correspond on the lug 8 and in the web of the corresponding upright 5, come into coincidence so that they can be traversed by assembly means, which project sufficiently on the periphery of the lamp so as to prevent the sleeve 4 sliding upwardly beyond the glass 3 and being separated from the lamp assembly.

These assembly means can be formed by a pin or screws.

For permitting the sleeve 4 to slide upwardly until its upper edge reaches the level of the cover 7, notches 14 are formed in the upper rim of the sleeve 4, which notches are capable of extending around the said assembly means.

Two or more parallel uprights 5 can be provided on a single lamp, the sleeve then having a corresponding number of ribs 6.

As regards the particularly simple constructional form which is shown in the drawings, the lamp is made with only diametrically opposite uprights 5 and the cover 7 has only two corresponding lugs 8, and the assembly means are formed by a handle 15, the ends of which are directed facing one another along the same axis so as to form pivots respectively passing through the holes 13, 12 of the superimposed parts of the uprights 5 and the lugs 8. These pivots 16 are extended towards the axis of the lamp beneath the cover 7, above the upper edge or rim of the glass 3. This penetration of the pivots 16 towards the axis of the lamp is limited by stops 17 which advantageously form part of a leaf spring 18 which is suitably shaped for being fixed to the cover 7, for example, by means of a central rivet 19, and which bears diametrically by its ends on the glass 3 for pushing it resiliently on to the base 1.

It is seen that the handle 15, together with its pivots 16, can be obtained from a single shaped part consisting of a metallic wire having a flexural elasticity sufficient for permitting the assembly.

Figure 2:
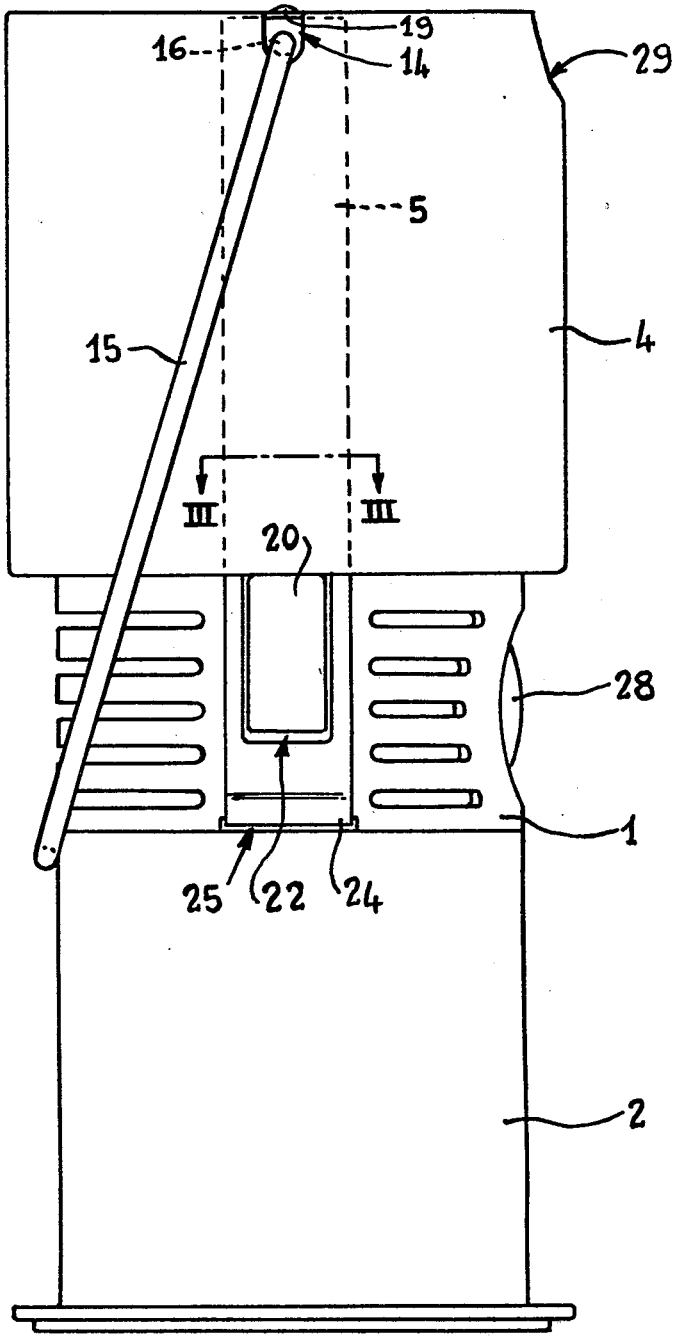
FIG. 2 is an elevation of the same lamp turned through 90° about its vertical axis, in its protected position, ready to be transported among the luggage, loosely with other articles.

Furthermore, it is appropriate to provide on the base 1 means which permit the sleeve 4 to be locked, at least in its top position, shown in FIG. 2, in which it completely encloses the glass 3.

For this purpose, it is advantageous to use a push member 20, which is capable of being forced into the base 1 against the action of a spring 21 and of which the substantially rectangular head, nested in an opening 22, formed in the base of the upright 5, between the wings or flanges 9 of the latter, projects slightly beyond this base. This head of the push member 20 is situated approximately at midheight of the lamp, and this makes it possible, when the sleeve 4 is pushed upwardly as far as the end of its movement, of being engaged elastically on the bottom rim of this sleeve and, on the other hand, when the sleeve 4 is situated in its extreme bottom position as shown in FIG. 1, of being engaged above the upper rim of this same sleeve, thus locking it automatically in its two extreme positions, as soon as it is brought into one or other of the positions.

The substantially cylindrical base 1 comprises a cast or moulded peripheral flange or collar 23 which project from its internal surface and to which each of the uprights 5 is fixed by its bottom end 24 which is set at right-angles and penetrates horizontally into the base 1 through a corresponding hole 25 flush with the internal surface of the collar 23, against which this end is fixed by means of a screw 26. The same screw 26 can serve for fixing a metal plate 27 by its edge in the base 1, said plate serving as a support for different functional members (not shown) of the lamp, such as the burner, the sleeve support, the control cock (of which the operating button is seen at 28), the gas inlet head connected to the incorporated cartridge and possibly an igniting device capable of being operated by the buttom 28 when the latter opens the cock, with which it is integral. It is then possible to lock the collar or flange 23 in sandwich form between the lower end 24 of the upright 5 and the rim of the plate 27, the said ends, flange and rim, having the screw 26 extending completely through them.

It will be noted that the sleeve 4 can be obtained from a single piece by injection moulding of plastic material, by providing in the mould corresponding moulds for directly obtaining, by moulding, the ribs 6, the cut-outs 14 and also a cut-out 29 in the form of a circular arc in the upper rim of this sleeve and which is intended for facilitating access to the buttom 28 when the sleeve 4 is in its extreme bottom position as shown in FIG. 1.

It must moreover be understood that the foregoing description has only been given as an example and that it does not in any way limit the scope of the invention, from which there would be no departure if the details of execution as described are replaced by any other equivalents.

I claim:

1. A portable gas lamp of the type employing an incandescent mantle, comprising;

a cylindrical base;

a cylindrical glass chimney for surrounding said incandescent mantle, the chimney extending upwardly from the base and being supported thereon;

multiple mutually parallel upright posts secured at their lower ends to the base, the posts extending upwardly from said base parallel to and outside of the glass chimney and having upper ends terminating near the upper end of said glass chimney;

a cylindrical sleeve surrounding the lamp and movable upwardly to a first position wherein it protectively covers the glass chimney, and downwardly to a second lower position wherein it uncovers the glass chimney and surrounds the base;

cooperative sleeve support means carried by said upright posts and said cylindrical sleeve for securing the sleeve to the lamp and for slidingly guiding said sleeve along said posts between said first and second positions; and a cover extending horizontally over and spaced from the glass chimney, and means securing the cover to the upper ends of said parallel upright posts.

2. A portable gas lamp as claimed in claim 1, further comprising a carrying handle made of bowed metallic wire, said handle having two ends turned inwards and secured in the cover along a common horizontal axis, the ends having portions extending from the lamp and operative to interfere with the upper end of the sleeve and stop upward motion of the sleeve when it reaches said first position.

3. A portable gas lamp as claimed in claim 1, further comprising locking means for the sleeve, said locking means yieldably projecting from the base at substantially mid-height of the lamp, and being positioned for engangement with the lower edge of the sleeve in its first position and with the upper edge of same sleeve in its second position.

4. A portable gas lamp of the type employing an incandescent mantle, comprising:

a cylindrical base;

a cylindrical glass chimney for surrounding said incandescent mantle, the chimney extending upwardly from the base and being supported thereon;

multiple mutually parallel upright posts secured at their bottom ends to the base, the posts extending upwardly from said base parallel to and outside of the glass chimney and having upper ends terminating near the upper end of said glass chimney;

a cover extending horizontally over and spaced from the glass chimney;

securing lugs on said cover for securing the cover to the upper ends of said posts, said securing lugs extending downwardly from the cover and superimposed adjacent the upper ends of said upright posts;

a carrying handle made of a single length of bowed metallic wire; and means for assembling together the superimposed securing lugs of the cover with the respective upright posts, the lugs and the upper ends of two posts having aligned holes extending therethrough, and the ends of the handle wire having portions bent to extend through said holes along a common horizontal axis and secure the lugs and posts together.

5. A portable gas lamp as claimed in claim 4, wherein each upright post comprises a web with two lateral flanges, each flange having a notch formed in its upper end, and wherein each securing lug comprises a portion adapted to lie against a web between two lateral flanges and an enlarged portion in the form of a shoulder adapted to nest in the two notches of each upright post.

6. A portable gas lamp as claimed in claim 4, further comprising a leaf spring secured to the cover and disposed to resiliently push the glass chimney onto the base, the leaf spring having stops abutting the end portions of said handle which extend through said aligned holes.

7. A portable gas lamp as claimed in claim 4, wherein the base has a horizontal flange projecting from its internal surface and has apertures extending horizontally therethrough adjacent the flange, and wherein the lower ends of the upright posts are inwardly directed and penetrate into the base through said apertures and are fixed to said flange of the base.

8. A portable gas lamp as claimed in claim 7, further comprising a support plate within said chimney and serving as a support for said incandescent mantle of the lamp, the support plate having a lower portion overlying said flange of the base and being secured by screws which extend through the lower portion, through the flange, and through the lower end of a post.

* * * * *